United States Patent [19]

Mitchell

[11] 4,138,519

[45] Feb. 6, 1979

[54] CONDUCTIVE SECONDARY BACKINGS AND TUFTED CARPETS MADE THEREWITH

[75] Inventor: Philip B. Mitchell, Smyrna, Ga.

[73] Assignee: Standard Oil Company (Indiana), Chicago, Ill.

[21] Appl. No.: 830,889

[22] Filed: Sep. 6, 1977

[51] Int. Cl.[2] ..... D03D 15/02

[52] U.S. Cl. ..... 428/95; 139/399; 139/420 R; 139/425 R; 139/426 R; 139/426 TW; 428/253; 428/254; 428/255

[58] Field of Search ..... 428/95, 85, 92, 96, 428/97, 253, 254, 255; 139/2, 37, 116.5, 399, 420 R, 425 R, 426 R, 426 TW

[56] References Cited

U.S. PATENT DOCUMENTS

| | | | |
|---|---|---|---|
| 3,309,259 | 3/1967 | Schwartz | 428/97 |
| 3,475,898 | 11/1969 | Magat | 57/140 |

*Primary Examiner*—Marion E. McCamish

*Attorney, Agent, or Firm*—Thomas J. Connelly; Arthur G. Gilkes; William T. McClain

[57] ABSTRACT

Secondary backing for a tufted carpet comprising a fabric with an open construction having an air permeability preferably of at least about 350 cfm of a synthetic yarn and a conductive spun yarn wherein said spun yarn comprises a conductive core fiber having a denier in the range of about 15 to about 25 and a maximum resistance of about $1 \times 10^{10}$ ohms/centimeter around which core fiber is spun a nonconductive support fiber having a denier in the range of about 3 to 18. The conductive spun yarn can be in the warp and/or weft direction of said backing at an apparent weight density of conductive fiber as low as 0.6 grams/square meter and still dissipate a static charge to a value in kilovolts below about 4.5.

8 Claims, No Drawings

CONDUCTIVE SECONDARY BACKINGS AND TUFTED CARPETS MADE THEREWITH

BACKGROUND OF THE INVENTION

1. Field of the Invention

The use of conductive fibers in tufted carpets as a means for dissipating static charge is the field of this invention.

2. Prior Art

There are many methods for dissipating static charges in tufted carpets by using a conductive primary backing. Examples of U.S. patents disclosing conductive fibers which can be used in the primary backings of the prior art and the secondary backing of this invention are: U.S. Pat. Nos. 3,969,559 (1976), 3,836,422 (1974), 3,806,401 (1974), 3,778,331 (1973), 3,713,960 (1973), 3,690,057 (1972), 3,669,736 (1972), 3,206,923 (1965), 3,129,487 (1964).

Electrically conductive undercoatings such as in U.S. Pat. No. 2,302,003 (1942) have not achieved widespread commercial acceptance because: (1) the bonding strength of latex compositions is significantly reduced whenever fillers such as conductive carbon black or other fillers to make a conductive coating are present; (2) to make up for any lessening of latex bond strength excess film forming polymer must be used, which significantly increases manufacturing costs; (3) in the case of conductive carbon black as filler, there are adverse aesthetic consequences from binder and filler bleed-through; (4) the process of coating with filled conductive latex compositions have many manufacturing difficulties; and (5) such coatings, as expressly pointed out in U.S. Pat. No. 2,302,003, must contact whatever conductive pile loops are used in order to dissipate adequately static charge.

It is to be noted that the conductive pile yarns are in general required in order to maintain a kilovolt potential determined according to AATCC 134 (1969) below about 4.5 kilovolts (KV) regardless of the further means used to dissipate such static charge.

Another method for producing tufted carpets which prevents high static charge buildup is to modify the otherwise nonconductive primary backing by incorporating conductive fibers directly into the primary backing either as components in the woven or nonwoven web or as part of a fleece layer needle-bonded thereto. Examples of such art are U.S. Pat. Nos. 3,955,022 (1976), 3,900,,624 (1975), 3,806,401 (1974), 3,713,960 (1973) and 3,639,807 (1972). Modification of the primary backing is a commercially accepted method, but unfortunately, necessarily gives rise to a significant increase in inventory due to the variety of primary backing colors and/or constructions which must be duplicated both as conductive and nonconductive backings.

Another method for dissipating a charge from a tufted carpet other than by directly modifying the primary backing is disclosed in U.S. Pat. No. 3,728,204 (1973). In U.S. Pat. No. 3,728,204, an aluminum foil is laminated directly to the loop side of a tufted carpet, wherein the foil is positioned so as to be in direct electrical conductive contact with respect to the yarn projecting from said loop side.

Foil lamination is not extensively used commercially probably because of (1) the production problems in uniformly laminating a foil to the loop side of a tufted carpet, which may explain the use in U.S. Pat. No. 3,728,204 of a pin roller to pierce the metal foil so as to make contact with the pile loops, and (2) the undesirable aesthetics arising from having a highly reflective substrate. It is important to emphasize that as taught in U.S. Pat. No. 3,728,204 there is a requirement that before static charge can be dissipated satisfactorily an electrical contact between the conductive pile and the foil must be present because such a limitation has surprisingly been found not to be required by this invention.

It is an object of this invention to avoid static charge buildup in tufted carpets of kilovolts in excess of about 4.5 KV as measured according to AACCT 134 (1969) by means of a conductive secondary backing.

It is an object of this invention to provide a conductive secondary backing which overcomes all of the problems and limitations of prior art methods of lessening static charge buildup while being capable of dissipating static charges to a value in kilovolts of less than about 4.5 KV.

Other objects of this invention are clear from the Specification.

BRIEF DESCRIPTION OF THE INVENTION

A secondary backing or fabric suitable for use as a secondary backing in a tufted carpet, in general, and in this invention, in particular, must have a strength of at least about 40 pounds tensile in both the warp and weft directions as measured according to ASTM D-1682 and be easily adhesively laminated to a tufted primary backing by some method commonly used in the art. An example of one such method is roller coating a filled styrene-butadiene-rubber latex formulation so as to achieve a minimum pull strength of at least about 2.5 pounds/inch as defined in UM 44C, an FHA specification.

In general, the synthetic yarn fabrics of this invention are of an open construction to permit aqueous latexes or other binder systems commonly used in the manufacture of tufted carpets to penetrate readily through and around the fibers of the conductive secondary backing. A measure of this open construction is the value in cubic feet per minute (cfm) of air passing through a fabric as measured according to ASTM D-737-46. Generally, fabrics with a value of at least about 350 cfm provide the best overall adhesion, with a most preferred value above about 650 cfm. Examples of useful synthetic yarns are polyesters, polyamides, polyolefins and the like.

Examples of some of the variety of fabric constructions useful in the secondary backing of this invention are: a leno or a plain weave each having an end X pick count in the range of about 12–30 X about 6–20, and preferably 16–20 X 8–10, and in the warp direction a denier in the range of about 350–1000, with a preferred range of about 400–500 and in the weft direction a denier in the range of about 1200 to 2500, with a preferred range of about 1500 to 2000; and other known fabric constructions such as a basket, twill, or knit construction with appropriately chosen fiber deniers which will provide an air permeability of at least about 350 cfm.

The conductive spun fiber of this invention comprises a conductive core having a denier in the range of about 15 to about 25 around which a nonconductive fiber having a denier in the range of about 3 to about 18 is spun. There is a preferred limit as to the number of twists per inch of the nonconductive fiber which is in the range of about 1¾ to about 4 twists or turns per inch.

If there are too few turns per inch the resulting conductive spun fiber will have too low a strength to be weavable and/or the strength of the resulting fabric will be too low. On the other hand, the more turns per inch, the higher the production cost of the fiber.

The conductive fibers of this invention have a tenacity preferably of at least about 2 grams/denier measured according to ASTM D 2256-69 and a maximum resistance in ohms/centimeter measured according to TPM-73-3 of about $1 \times 10^{10}$.

Preparation of a reinforced conductive yarn or conductive spun yarn such as required by this invention is disclosed in U.S. Pat. No. 3,206,923 (1965) incorporated hereby by reference.

DETAILED DESCRIPTION OF THIS INVENTION

Preparation of a Secondary Conductive Backing

The spun conductive yarn of a secondary conductive backing of this example was prepared at 4,700 revolutions per minute on a Roberts WR-2 spinning frame having a 5½ inch ring with a 12 inch up and down traverse. A Dow Badische F 911 fiber, the conductive core fiber, having a denier of 21 was maintained at sufficient tension to keep it straight while crimped polypropylene fibers of 6 denier and 5 inch length were wound around it with 3.2 turns of Z twist to produce a final conductive spun yarn having a denier of about 1781.

Secondary backings of 8 picks per inch and 9 picks per inch of this spun conductive yarn were manufactured with a leno construction substantially similar respectively to styles 3800 and 3802 sold by Amoco Fabrics Company, Georgia. The fabric corresponding to style 3800 hereinafter referred to as Secondary Backing A has 16 end yarns per inch by 8 pick yarns per inch and the fabric corresponding to style 3802 hereinafter referred to as Secondary Backing B has 20 end yarns per inch by 9 pick yarns per inch. The yarn used in the weft direction was the spun conductive yarn having a total denier of about 1781 and the yarn used in the warp direction was a fiber of slit polypropylene film having a denier of about 520.

Each of these secondary backings and an Action Bac style 3802 sold by Amoco Fabrics Company, Georgia, were adhesively laminated to several primary backings of Poly Bac style 2400 sold by Amoco Fabrics Company, Georgia, which primary backings had been tufted with 100% nylon spun fibers containing 0.08% F 911 sold by Dow Badische to a pile density in Case 1 of 20 ounces/square yard, in Case 2 of 24 ounces/square yard, and in Case 3 of 36 ounces/square yard.

These tufted carpets were evaluated for static buildup in a Stroll Test at 20% relative humidity and 70° F. according to AATCC 134 (1969). The results are given in the following table:

| | Static Results in Kilovolts | | |
|---|---|---|---|
| | Case 1 | Case 2 | Case 3 |
| Action Bac Style 3802 | 6.4 | 5.3 | 5.0 |
| * Backing A | 4.6 | 3.8 | 3.3 |
| ** Backing B | 4.8 | 3.5 | 3.4 |

*Apparent density of conductive fiber contained therein is 0.6 gm/sq. yd.
**Apparent density of conductive fiber contained therein is 0.7 gm/sq. yd.

As means for evaluating the performance of the conductive secondary backings of this invention to a conductive primary backing of the prior art, the following tufted carpets were made and tested.

Poly Bac Style 2400 with a needled fleece layer of 2¼ oz./sq. yard comprising primarily nylon fibers in which F 911 fibers having an apparent density thereof of 1.0 gram (gm)/sq. yard having a 6 inch average length and a 21 denier was tufted with the previously cited conductive pile yarns to a pile density in Case 4 of 20 oz./sq.yd., in Case 5 of 24 oz./sq.yd., and in Case 6 of 36 oz./sq.yd. Secondary backing Style 3802 was adhesively laminated to each of these tufted primary backings and tested as hereinbefore. The results are in the following table:

| | Static Results in Kilovolts | | |
|---|---|---|---|
| | Case 4 | Case 5 | Case 6 |
| Style 3802 | 3.4 | 3.4 | 3.0 |

Variations on the examples herein are readily apparent to a man of average skill in the art and are intended to be within the scope of this invention.

The invention which is claimed is:

1. A conductive secondary backing suitable for use in a tufted carpet comprising a fabric with an open construction of synthetic yarns and a conductive spun yarn, wherein said spun yarn comprises a conductive core fiber having a denier in the range of about 15 to about 25 and a maximum resistance of about $1 \times 10^{10}$ ohms/centimeter around which is spun a nonconductive fiber having a denier in the range of about 3 to 18 with a twist of at least about 1¾ twists per inch.

2. The conductive secondary backing of claim 1, wherein said conductive spun yarn is in one of a warp and a weft direction and the backing has an air permeability of at least about 350 cubic feet per minute as measured according to ASTM D-737-46.

3. A tufted carpet having a secondary backing comprising the conductive secondary backing of claim 2.

4. The conductive secondary backing of claim 1, wherein said open construction is selected from the group consisting of a leno, basket, twill, and knit construction.

5. A tufted carpet having a secondary backing comprising the conductive secondary backing of claim 4.

6. A tufted carpet having a secondary backing comprising the conductive secondary backing of claim 1.

7. A conductive secondary backing suitable for use in a tufted carpet comprising a fabric having an end by pick count in the range of about 12 to 30 by about 6 to 20 and a synthetic yarn fiber in the warp direction with denier in the range of about 350 to 1000 and a synthetic yarn fiber in the weft direction with denier in the range of about 1200 to 2500 and a conductive spun yarn, wherein said spun yarn comprises a conductive core fiber having a denier in the range of about 15 to about 24 and a maximum resistance of about $1 \times 10^{10}$ ohms/centimeter as measured according to TPM-73-3 around which is spun a nonconductive fiber having a denier in the range of about 3 to 18 with a twist of at least about 1¾ twists per inch.

8. A tufted carpet having a secondary backing comprising the conductive secondary backing of claim 7.

* * * * *

UNITED STATES PATENT AND TRADEMARK OFFICE

CERTIFICATE OF CORRECTION

PATENT NO. : 4,138,519

DATED : February 6, 1979

INVENTOR(S) : Philip B. Mitchell

It is certified that error appears in the above-identified patent and that said Letters Patent are hereby corrected as shown below:

Column 1, line 49 "3,900,,624" should read -- 3,900,624 --

Column 2, line 13, "AACCT 134" should read -- AATCC 134 --

Column 3, line 14, "hereby" should read -- herein --

Column 4, line 41, "claim 2" should read -- claim 1 --

Column 4, line 47, "claim 4" should read -- claim 2 --

Column 4, line 49, "claim 1" should read -- claim 4 --

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*